US009752220B2

(12) United States Patent
Kitamura et al.

(10) Patent No.: US 9,752,220 B2
(45) Date of Patent: Sep. 5, 2017

(54) MAGNESIUM ALLOY COIL STOCK

(75) Inventors: Takahiko Kitamura, Itami (JP); Ryuichi Inoue, Itami (JP); Nobuyuki Mori, Itami (JP); Yukihiro Oishi, Osaka (JP); Osamu Mizuno, Itami (JP); Nozomu Kawabe, Osaka (JP)

(73) Assignee: SUMITOMO ELECTRIC INDUSTRIES, LTD., Osaka (JP)

( * ) Notice: Subject to any disclaimer, the term of this patent is extended or adjusted under 35 U.S.C. 154(b) by 869 days.

(21) Appl. No.: 13/511,920

(22) PCT Filed: Nov. 22, 2010

(86) PCT No.: PCT/JP2010/070818

§ 371 (c)(1),
(2), (4) Date: May 24, 2012

(87) PCT Pub. No.: WO2011/065331

PCT Pub. Date: Jun. 3, 2011

(65) Prior Publication Data

US 2012/0276402 A1 Nov. 1, 2012

(30) Foreign Application Priority Data

| | | |
|---|---|---|
| Nov. 24, 2009 | (JP) | 2009-266069 |
| May 21, 2010 | (JP) | 2010-117630 |
| Nov. 22, 2010 | (JP) | 2010-259733 |

(51) Int. Cl.

| | |
|---|---|
| ***C22F 1/06*** | (2006.01) |
| ***B21B 3/00*** | (2006.01) |
| ***C22C 23/02*** | (2006.01) |
| *B21B 15/00* | (2006.01) |

(52) U.S. Cl.
CPC ..... *C22F 1/06* (2013.01); *B21B 3/00* (2013.01); *C22C 23/02* (2013.01); *B21B 2015/0057* (2013.01); *Y10T 428/1241* (2015.01)

(58) Field of Classification Search
CPC ..... C22F 1/06
See application file for complete search history.

(56) References Cited

U.S. PATENT DOCUMENTS

| | | | | |
|---|---|---|---|---|
| 2,060,071 | A * | 11/1936 | Lowry | C22F 1/06 148/667 |
| 8,828,158 | B2 * | 9/2014 | Inoue et al. | 148/557 |
| 2011/0067474 | A1 * | 3/2011 | Tazoe et al. | 72/200 |

FOREIGN PATENT DOCUMENTS

| | | | | | |
|---|---|---|---|---|---|
| CN | 101108393 | A | | 1/2008 | |
| CN | 101168167 | A | | 4/2008 | |
| CN | 101279333 | A | | 10/2008 | |
| CN | 101279333 | A | | 10/2009 | |
| JP | H11188478 | A | | 7/1999 | |
| JP | 2002-121657 | A | | 4/2002 | |
| JP | 2002-126806 | A | | 5/2002 | |
| JP | 2002126806 | A | * | 5/2002 | B21B 3/00 |
| JP | 2002348691 | A | | 12/2002 | |
| JP | 2006172720 | A | | 6/2006 | |
| JP | 2007044751 | A | | 2/2007 | |
| JP | 2007-118064 | A | | 5/2007 | |
| JP | 2008-308703 | A | | 12/2008 | |
| JP | 2009-113090 | A | | 5/2009 | |
| JP | 2009113090 | A | | 5/2009 | |
| TW | 200920858 | A | | 5/2009 | |
| TW | 200927314 | A | | 7/2009 | |
| WO | WO 2009/001516 | A1 | | 12/2008 | |
| WO | WO 2009001516 | A1 | * | 12/2008 | C22C 23/02 |
| WO | 2009/051176 | A1 | | 4/2009 | |
| WO | WO 2009/051176 | A1 | * | 4/2009 | B21B 1/32 |
| WO | WO 2009051176 | A1 | * | 4/2009 | B21B 1/34 |

OTHER PUBLICATIONS

Notes: English translation of JP 2002126806 A is provided at the end of the JP 2002126806 A document. US 2011/0067474 A1 is used as the US equivalent of WO 2009/051176 A1 U.S. Pat. No. 8828158 B2 is used as the US equivalent of WO 2009/001516 A1.*
Office Action for Corresponding Chinese Application 201080053304.4 issued Dec. 2, 2013.
Taiwanese Office Action for related Taiwanese Patent Application No. 099140284 dated Feb. 13, 2015, 9 pages.
Japanese Office Action for related Japanese Patent Application No. 2010-259733 dated Mar. 11, 2015, with English-language summary, 5 pages.
International Search Report for PCT Application No. PCT/JP2010/070818 dated Feb. 1, 2011, pp. 1-2.

* cited by examiner

*Primary Examiner* — Jie Yang
*Assistant Examiner* — Jophy S Koshy
(74) *Attorney, Agent, or Firm* — Ditthavong & Steiner, P.C.

(57) ABSTRACT

There are provided a magnesium alloy coil stock having good flatness and a method for producing the magnesium alloy coil stock, and a magnesium alloy structural member that uses the coil stock and a method for producing the magnesium alloy structural member. The coil stock is obtained by coiling a sheet composed of a magnesium alloy in a cylindrical shape, and the internal diameter of the coil stock is 1000 mm or less. The coil stock can be produced by rolling a cast material obtained by subjecting a magnesium alloy to continuous casting, subjecting the rolled sheet to warm leveling, and coiling the worked sheet in a cylindrical shape while the temperature just before coiling is decreased to 100° C. or less.

9 Claims, 2 Drawing Sheets

(a)

(b)

MAGNESIUM ALLOY COIL STOCK

TECHNICAL FIELD

The present invention relates to a magnesium alloy coil stock that is suitable as a raw material of magnesium alloy structural members and a method for producing the magnesium alloy coil stock, and to a magnesium alloy structural member produced from the coil stock and a method for producing the magnesium alloy structural member. In particular, the present invention relates to a magnesium alloy coil stock that has good flatness and can contribute to an improvement in the productivity of magnesium alloy structural members such as a press-formed product.

BACKGROUND ART

Magnesium alloys containing magnesium and various additive elements are lightweight and have high specific strength and specific rigidity and good shock absorbency. Therefore, magnesium alloys have been examined as materials for housings of mobile electric and electronic devices such as cellular phones and laptop computers and materials for parts of automobiles. Since magnesium alloys have a hexagonal crystalline structure (hexagonal close-packed (hcp) structure), they have poor plastic formability at room temperature. Therefore, magnesium alloy structural members are mainly formed of cast materials (e.g., AZ91 alloy of American Society for Testing and Materials (ASTM) standard) by a die casting process or a thixomolding process. However, when a thin sheet, in particular, the above-described structural member is mass-produced, it is difficult to produce a long sheet suitable for such a thin sheet or structural member by the casting process above.

Wrought magnesium alloys such as AZ31 alloy of the ASTM standard are relatively easily subjected to plastic forming. Therefore, it has been examined that the thickness of a cast sheet composed of the wrought magnesium alloy is decreased by subjecting the cast sheet to plastic forming such as rolling or press forming. Patent Literature 1 discloses a sheet including a shear zone left therein by providing bending to a rolled sheet composed of an alloy containing Al in substantially the same amount as that of AZ91 alloy using a roll leveler. This sheet can be continuously recrystallized during press forming and thus has good press formability. Furthermore, since AZ91 alloy and the alloy containing Al in substantially the same amount as that of AZ91 alloy have high corrosion resistance and strength, such an alloy is expected to be increasingly demanded as a wrought material.

CITATION LIST

Patent Literature

Patent Literature 1: WO2009/001516

SUMMARY OF INVENTION

Technical Problem

An improvement in the productivity of magnesium alloy structural members has been demanded.

To improve the productivity of magnesium alloy structural members, when plastic forming such as press forming and other processings are performed, a raw material is desirably supplied to a working machine in a continuous manner. For example, by using, as a raw material, a coil stock obtained by coiling a sheet such as a long rolled sheet in a cylindrical shape, the raw material can be supplied to the working machine in a continuous manner.

However, a coil stock may have poor flatness because of its curling and warpage in the width direction.

If the coiling diameter (internal diameter) of a coil stock is decreased, a small coil stock can be achieved even if a long sheet is used. Thus, it is expected that the conveyance and the installment in the working machine are easily achieved, the amount of raw material that can be supplied to the working machine from a single coil stock can be increased, and the productivity of magnesium alloy structural members is further improved. However, if the coiling diameter is small, in particular, if the coiling diameter is 1000 mm or less, curling is easily formed on the sheet, in particular, deformation and warpage may be formed in the longitudinal direction of the sheet. If the number of turns is increased, the coiling diameter increases and thus the deformation and warpage in the longitudinal direction can be suppressed. However, warpage in the width direction is easily formed as described below.

In the case where the deformation such as curling and the warpage (bending) are formed, the sheet is bent and does not become flat only through uncoiling of the coil stock. When such a bent sheet is supplied to a working machine, it becomes difficult to precisely align the sheet at the predetermined position of the working machine that performs processings for changing a shape, such as punching and plastic forming, e.g., press forming. As a result, a member subjected to plastic forming cannot be precisely produced and the yield is decreased due to size failure, which decreases the productivity of magnesium alloy structural members. If additional leveling or the like is performed to precisely align the sheet in the working machine, the deformation and warpage in the longitudinal direction can be leveled, but the productivity of magnesium alloy structural members degrades because of an increase in the number of steps. In addition, a suitable working machine that levels the deformation and warpage in the width direction of magnesium alloy sheets has not been known, and thus it is difficult to remove the deformation and warpage in the width direction.

Accordingly, an object of the present invention is to provide a magnesium alloy coil stock having good flatness and a method for producing the magnesium alloy coil stock. Another object of the present invention is to provide a magnesium alloy structural member obtained from the coil stock and a method for producing the magnesium alloy structural member.

Solution to Problem

The inventors of the present invention have examined various methods for increasing the flatness of an uncoiled sheet using a coil stock composed of a magnesium alloy as a raw material of magnesium alloy structural members such as a press-formed product.

When plastic forming such as rolling or press forming is performed on a magnesium alloy, a so-called warm working in which working is performed while a raw material composed of a magnesium alloy is heated is preferably performed to improve the plastic formability of a magnesium alloy. For example, consider the case where a long thin sheet is produced by subjecting a raw material such as a twin-roll cast material to warm rolling. If a sheet subjected to rolling in a rolling step is coiled while the sheet is heated, the sheet easily deforms because the plastic formability is increased as described above. As a result, curling (warpage) is easily formed on the sheet.

In particular, when a wide sheet is produced, a variation in thickness (thickness distribution) in the width direction of the sheet is easily caused. If such a sheet having a variation in thickness in the width direction is sequentially coiled, the diameter of the obtained coil stock also varies in the width direction and a uniform column shape is not achieved. For example, when the thickness of a central portion in the width direction of the sheet is larger than that of edge portions, the obtained coil stock has a drum-like shape in which the central portion in the width direction expands. When coiling is performed while a sheet is heated as described above, warpage that follows the drum-like shape may be left on the sheet as permanent deformation. This permanent deformation serves as warpage in the width direction. In particular, regarding turns on the outside constituting the coil stock, as the number of turns increases, a variation in the diameter in the width direction of the coil stock is easily increased because deformation of turns on the inside is accumulated. Therefore, turns on the outside constituting the coil stock tend to have large warpage in the width direction.

Even in a sheet having a small variation in thickness in the width direction or substantially no variation, when warm rolling is performed, both ends of the sheet in the width direction are easily cooled compared with the central portion. This temperature difference causes different degrees of thermal expansion in the width direction of the sheet, and thus the central portion is easily expanded. That is, even if a sheet having a small variation in thickness is used, the thickness is temporarily different depending on the position until the entire sheet has a uniform temperature. If coiling is performed in such a state, the coil stock may have a drum-like shape as described above. When this deformation is maintained (left as permanent deformation) after the coiling, the deformation may become warpage in the width direction as described above.

In the case where a short sheet is used, deformation due to curling and warpage in the width direction are sometimes not formed. In a long sheet used in the form of a coil stock, the flatness is decreased due to the deformation and warpage and the productivity of coil stocks and magnesium alloy structural members degrades (the yield of products decreases).

In view of the foregoing, the inventors of the present invention have found that, when warm working is performed and then a sheet is coiled after the temperature of the sheet is decreased to a certain low temperature just before coiling, warpage in the width direction that follows the outline of a coil stock can be suppressed and curling is not easily formed on a coiled sheet. In addition, even if the obtained coil stock is uncoiled, the sheet has good flatness. The present invention is based on the findings above.

A magnesium alloy coil stock of the present invention is produced by coiling a sheet composed of a magnesium alloy in a cylindrical shape, wherein the internal diameter of the coil stock is 1000 mm or less, and the coil stock satisfies the amount of warpage in a width direction below:

(the amount of warpage in a width direction)

when the amount of warpage in a width direction (%) is defined by (maximum distance h in vertical direction/width w of test piece for warpage amount)×100%, the amount of warpage in a width direction is 0.5% or less, wherein, when a sheet located on an outermost peripheral side of the sheet constituting the coil stock is cut into a length of 300 mm to obtain a test piece for warpage amount and the test piece for warpage amount is placed on a horizontal table, the maximum distance in a vertical direction between a surface of the horizontal table and a portion of one surface of the test piece for warpage amount, the portion being not in contact with the horizontal table, in a width direction of the test piece for warpage amount is referred to as h and the width of the test piece for warpage amount is referred to as w.

The coil stock of the present invention has a small internal diameter of 1000 mm or less. Thus, a small coil stock can be achieved even if the number of turns is increased. In addition, this coil stock has a small amount of warpage even in an outermost periphery where warpage in the width direction is most easily formed and thus has good flatness. Therefore, in the coil stock of the present invention, a treatment for correcting warpage in the width direction is not required.

In one embodiment of the coil stock of the present invention, the coil stock satisfies a flatness below:

(Flatness)

when a sheet located on an innermost peripheral side of the sheet constituting the coil stock is cut into a length of 1000 mm to obtain a test piece for flatness and the test piece for flatness is placed on a horizontal table, the maximum distance in a vertical direction between a surface of the horizontal table and a portion of one surface of the test piece for flatness, the portion being not in contact with the horizontal table, is defined as a flatness, the flatness being 5 mm or less.

According to the embodiment above, only a small amount of deformation and warpage is formed both in the width direction and longitudinal direction of the sheet and such a sheet has good flatness. The coil stock of the present invention has a small internal diameter of 1000 mm or less as described above, and relatively sharp bending with a bend radius of 500 mm or less is applied to the sheet on the innermost peripheral side of the coil stock of the present invention. However, when the coil stock of the present invention is uncoiled, the sheet constituting the coil stock has good flatness as described above. That is, in the sheet, not only warpage in the width direction but also curling is not easily formed or is substantially not formed. Therefore, when a sheet obtained by uncoiling the coil stock of the present invention is directly supplied to a working machine that performs cutting and plastic forming such as press forming or when a sheet obtained by uncoiling the coil stock of the present invention and then by being subjected to simple leveling is supplied to a working machine, the sheet can be precisely aligned.

By using the coil stock of the present invention, a leveling step of removing warpage and deformation such as curling can be omitted or a time required for leveling can be shortened. Furthermore, by using the coil stock of the present invention, a raw material can be continuously supplied to a plastic forming machine. Therefore, magnesium alloy structural members having various shapes such as a three dimensional shape and a two-dimensional shape, e.g., a box and a plate can be produced with high productivity. Thus, the coil stock of the present invention can be suitably used as a raw material of magnesium alloy structural members and is expected to contribute to an improvement in the productivity of magnesium alloy structural members. Since the coil stock of the present invention that serves as a raw material has good flatness as described above, the above-described various processings can be precisely performed and it is expected that a magnesium alloy structural member with high dimensional accuracy is obtained.

In one embodiment of the present invention, the flatness is 0.5 mm or less.

As a result of the investigation conducted by the inventors of the present invention, they have found that, by setting the thickness and width of the sheet in a specific range or by performing leveling while a certain tension is applied to the sheet as described below, a coil stock having smaller flatness is obtained. According to the embodiment above, the flatness is significantly small and better flatness is achieved.

Examples of the magnesium alloy constituting a raw material used for the coil stock of the present invention, a magnesium alloy structural member of the present invention described below, and a method for producing a magnesium alloy coil stock of the present invention described below include various magnesium alloys having a composition including Mg and additive elements (balance: Mg and impurities). At least one element selected from Al, Zn, Mn, Si, Ca, Sr, Y, Cu, Ag, Ce, Sn, Li, Zr, Be, Ni, Au, and rare-earth elements (except for Y and Ce) is exemplified as the additive elements. As the content of the additive elements increases, the strength and corrosion resistance are improved. However, if the content is excessively high, cracks are easily formed due to defects caused by segregation and a reduction in plastic formability. Thus, the total content of the additive elements is preferably 20% or less by mass. An example of the impurities is Fe.

In one embodiment of the present invention, the magnesium alloy contains Al as an additive element in an amount of 5.8% or more by mass and 12% or less by mass. In one embodiment of the present invention, the magnesium alloy contains Al as an additive element in an amount of 8.3% or more by mass and 9.5% or less by mass.

A Mg—Al series alloy containing Al has high corrosion resistance. As the content of Al increases, the strength is improved and the corrosion resistance also tends to become high. However, if the content of Al is excessively high, plastic formability including bending degrades and cracks or the like may be formed during rolling, leveling, plastic forming, and the like. An increase in the temperature of a magnesium alloy during the above-described working to improve the plastic formability of the magnesium alloy requires energy for heating and a heating time, which decreases the productivity. Therefore, the content of Al is preferably 5.8% or more by mass and 12% or less by mass. The content of Al is more preferably 7.0% or more by mass and particularly preferably 8.3% or more by mass and 9.5% or less by mass because high strength and corrosion resistance are achieved. The total content of additive elements other than Al in the Mg—Al series alloy is preferably 0.01% or more by mass and 10% or less by mass and particularly preferably 0.1% or more by mass and 5% or less by mass.

In one embodiment of the present invention, the thickness of the sheet constituting the coil stock is 0.02 mm or more and 3.0 mm or less, and the width of the sheet constituting the coil stock is 50 mm or more and 2000 mm or less. In addition, the thickness of the sheet constituting the coil stock is 0.3 mm or more and 2.0 mm or less, and the width of the sheet constituting the coil stock is 50 mm or more and 300 mm or less.

According to the embodiment above, for example, the coil stock can be suitably used as a raw material for housings of mobile electric and electronic devices. In particular, in the case where a sheet has a thickness of 0.3 to 2.0 mm and a width of 300 mm or less, even if leveling is performed without applying a certain tension, a coil stock having a good flatness of 0.5 mm or less is easily obtained as described below.

In one embodiment of the present invention, the tensile strength of the sheet constituting the coil stock at room temperature (about 20° C.) is 280 MPa or more and 450 MPa or less. In one embodiment of the present invention, the 0.2% proof stress of the sheet constituting the coil stock at room temperature (about 20° C.) is 230 MPa or more and 350 MPa or less. In one embodiment of the present invention, the elongation of the sheet constituting the coil stock at room temperature (about 20° C.) is 1% or more and 15% or less. In one embodiment of the present invention, the Vickers hardness (Hv) of the sheet constituting the coil stock is 65 or more and 100 or less.

According to the embodiment above, good mechanical properties such as high strength, hardness, and toughness are achieved. The coil stock of the present invention can be suitably used as a raw material for members subjected to plastic forming, which are formed by being subjected to press forming or the like. The produced member subjected to plastic forming (magnesium alloy structural member of the present invention) also has high strength, high hardness, and high toughness.

In one embodiment of the present invention, the residual stress (absolute value) of the sheet constituting the coil stock is more than 0 MPa and 100 MPa or less.

In the case where the coil stock of the present invention is composed of a rolled sheet subjected to rolling or a worked sheet subjected to leveling, the sheet constituting the coil stock has compressive residual stress in any direction of its plane. For example, the sheet has a compressive residual stress of more than 0 MPa and 100 MPa or less as in the embodiment above. With residual stress, the sheet has good plastic formability because dynamic recrystallization is sufficiently caused during plastic forming. It is believed that a value of the residual stress may be used as an indicator which indicates the fact that the above-described worked sheet is used.

The coil stock of the present invention can be produced by, for example, the following production method of the present invention. A method for producing a magnesium alloy coil stock of the present invention includes a preparation step, a warm working step, and a coiling step below.

Preparation step: a step of preparing a raw material coil stock obtained by coiling a raw material sheet composed of a magnesium alloy in a cylindrical shape.

Warm working step: a step of continuously feeding the raw material sheet by uncoiling the raw material coil stock and working the fed raw material sheet while the raw material sheet has a temperature of more than 100° C.

Coiling step: a step of coiling the worked sheet to form a coil stock whose internal diameter is 1000 mm or less, The coiling step is performed after the temperature of the worked sheet just before coiling is decreased to 100° C. or less. In particular, the temperature just before coiling is preferably 75° C. or less.

According to the production method of the present invention, by performing warm working while the raw material sheet is heated to more than 100° C., the workability of the raw material sheet is improved and desired working can be properly performed. By preparing a coil stock long enough to be coiled as the raw material sheet, a long worked sheet is obtained. However, when the obtained worked sheet is coiled, heat generated during the working is left in the worked sheet and thus the worked sheet is easily subjected to plastic forming. In contrast, in the production method of the present invention, the temperature just before coiling is 100° C. or less and preferably 75° C. or less, which does not easily cause plastic forming. Therefore, the sheet after coiling is substantially not deformed or the amount of deformation is small. That is, in the production method of the present invention, significant warpage in the width direction is not easily formed and a cylindrical coil stock is easily obtained obviously when a sheet having a small variation in thickness in the width direction or having substantially no variation is used and even when a sheet having a variation in thickness in the width direction (a sheet in which, when the sheet is coiled while being heated, the outline of a coil stock may become a non-cylindrical shape such as a drum-like shape and thus significant warpage in the width direction is easily formed) is used. According to the production method of the present invention, the warpage and deformation in the width direction of the sheet constituting the coil stock can be reduced and furthermore the warpage and deformation in the longitudinal direction can be reduced.

In the case of a sheet constituting a first turn of a coil stock, the temperature just before coiling is a surface temperature at a position where the sheet is in contact with a coiling reel. In the case of a sheet constituting a second turn of a coil stock and turns thereafter, the temperature just before coiling is a surface temperature in a certain range (preferably about 0 to 2000 mm) from a position where the sheet is in contact with a start-of-coiling portion toward the upstream side (working means side where warm working is performed). Herein, the temperature just before coiling is an average of surface temperatures in the width direction of the sheet. The surface temperature can be easily measured using a contact temperature sensor such as a thermocouple or a noncontact temperature sensor such as a radiation thermometer.

In one embodiment of the production method of the present invention, in the warm working step, the raw material sheet is subjected to rolling with a reduction roll while the temperature of the fed raw material sheet is 150° C. or more and 400° C. or less. In particular, in this embodiment, a cast coil stock obtained by coiling a cast material obtained by subjecting a magnesium alloy to continuous casting is exemplified as the raw material coil stock prepared in the preparation step.

According to the embodiment above, the raw material sheet is rolled while being heated to a certain temperature, and the temperature of the obtained rolled sheet is decreased to a certain temperature (low temperature) just before coiling the rolled sheet. Therefore, a magnesium alloy coil stock (the coil stock of the present invention) having good flatness is obtained, for example, without performing leveling described below. In this embodiment, the leveling may be omitted, and thus the productivity of the coil stock is high. In this embodiment, a coil stock composed of a rolled sheet is obtained. In the case where a cast coil stock composed of a continuous cast material is used, since plastic formability such as rolling property is good, rolling can be properly performed. In addition, since the raw material sheet before rolling is a long sheet, a longer coil stock can be obtained.

In one embodiment of the production method of the present invention, in the preparation step, a rolled coil stock obtained by coiling a rolled sheet composed of a magnesium alloy is prepared as the raw material coil stock; and, in the warm working step, the rolled sheet is subjected to warm leveling with a plurality of rolls while the temperature of the rolled sheet is more than 100° C. and 350° C. or less.

According to the embodiment above, by leveling a certain raw material sheet (rolled sheet) that has been heated to a certain temperature and by decreasing the temperature of the leveled sheet to a certain temperature (low temperature) just before the leveled sheet is coiled, a magnesium alloy coil stock (the coil stock of the present invention) having good flatness is obtained. By setting the temperature of the rolled sheet during leveling in a certain temperature range, good plastic formability is provided to the rolled sheet and cracks are not easily formed during leveling. In addition, strain (shear zone) introduced by rolling can be sufficiently left. Therefore, according to this embodiment, a magnesium alloy coil stock (the coil stock of the present invention) having good flatness, surface texture, and plastic formability is obtained. In this embodiment, a coil stock composed of a worked sheet subjected to leveling is obtained.

In one embodiment of the production method of the present invention that performs leveling, the leveling is performed while a tension of 30 MPa or more and 150 MPa or less is applied to the rolled sheet.

According to the embodiment above, a magnesium alloy coil stock (the coil stock of the present invention) having better flatness, specifically, having a flatness of 0.5 mm or less can be produced.

In one embodiment of the production method of the present invention that performs leveling, in the preparation step, a rolled coil stock obtained by rolling a cast material obtained by subjecting a magnesium alloy to continuous casting and by coiling the rolled sheet is prepared as the raw material coil stock.

According to the embodiment above, by using a cast coil stock composed of a continuous cast material as described above, effects of properly performing rolling and easily obtaining a long sheet can be produced.

Advantageous Effects of Invention

The magnesium alloy coil stock of the present invention has good flatness. The coil stock can be produced with high productivity by the method for producing a magnesium alloy coil stock of the present invention. The magnesium alloy structural member of the present invention can be suitably used for various component parts. The method for producing a magnesium alloy structural member of the present invention can be suitably used for the production of the magnesium alloy structural member of the present invention.

DESCRIPTION OF EMBODIMENTS

Figure 1:
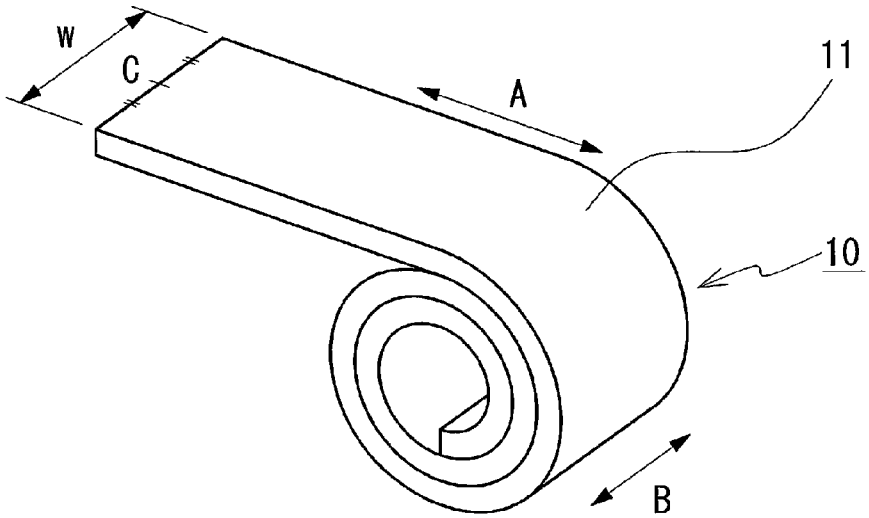
FIG. 1(*a*) is a perspective view of a coil stock, and FIG. 1(*b*) is a schematic view for describing a method for measuring the amount of warpage in the width direction.
Figure 1:
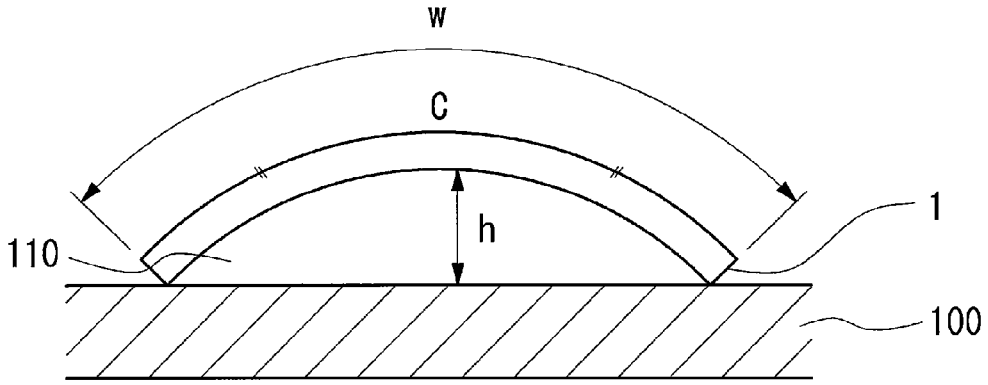

The present invention will now be described in detail.

[Coil Stock]

(Composition)

A magnesium alloy constituting the coil stock of the present invention and the magnesium alloy structural member of the present invention described below contains Mg as a base material. That is, the magnesium alloy contains Mg in an amount of 50% or more by mass and has a form containing various additive elements as described above. Specific examples of a Mg—Al series alloy containing Al include AZ series alloys (Mg—Al—Zn series alloys, Zn: 0.2 to 1.5% by mass), AM series alloys (Mg—Al—Mn series alloys, Mn: 0.15 to 0.5% by mass), and AS series alloys (Mg—Al—Si series alloys, Si: 0.01 to 20% by mass) of the ASTM standard; and Mg—Al-RE (rare-earth element) series alloys, AX series alloys (Mg—Al—Ca series alloys, Ca: 0.2 to 6.0% by mass), and AJ series alloys (Mg—Al—Sr series alloys, Sr: 0.2 to 7.0% by mass). Examples of the AZ series alloys containing 5.8% or more by mass of Al include AZ61 alloy, AZ80 alloy, and AZ91 alloy (Al: 8.3 to 9.5% by mass, Zn: 0.5 to 1.5% by mass). AZ91 alloy has high corrosion resistance and good mechanical properties such as high strength and hardness and also has general versatility compared with other Mg—Al series alloys such as AZ31 alloy. However, since the Al content of AZ91 alloy is high, AZ91 alloy has high hardness and thus has low plastic formability, which easily causes cracking during plastic forming. Therefore, by applying the production method of the present invention to AZ91 alloy or an alloy containing Al in substantially the same amount as that of AZ91 alloy, a long sheet having good flatness and plastic formability is obtained.

In addition, when the magnesium alloy constituting the coil stock of the present invention and the magnesium alloy structural member of the present invention described below contain at least one element selected from Y, Ce, Ca, and rare-earth elements (except for Y and Ce) in a total amount of 0.001% or more by mass, preferably in a total amount of 0.1% or more by mass and 5% or less by mass, the coil stock and the magnesium alloy structural member have high heat resistance and flame resistance.

(Form)

Typical examples of the form of the sheet constituting the coil stock of the present invention include rolled sheets obtained by rolling a cast material and worked sheets obtained by further leveling the rolled sheets.

(Internal Diameter)

As the internal diameter decreases, a smaller coil stock is obtained even if the number of turns is increased. However, it is believed that warpage in the width direction is easily formed unless a special production method is employed. In the case of a coil stock having a large internal diameter of more than 1000 mm, it is believed that, since a bend of the sheet constituting the coil stock is gentle, curling (mainly warpage in the longitudinal direction) is not easily formed even if a special production method is not employed. The coil stock of the present invention is produced by a special production method as described above, and thus is a coil stock having an internal diameter of 1000 mm or less, in which warpage in the width direction and carling are believed to be easily formed if a conventional production method is employed. As the internal diameter decreases, a smaller coil stock is obtained even if the number of turns is increased. For example, the internal diameter may be 300 mm or less. A coil stock having an internal diameter of 400 mm or more and 700 mm or less is believed to be readily utilized. The external diameter of the coil stock of the present invention can be suitably selected as long as the size of the coil stock is not excessively increased. A coil stock having an external diameter of 3000 mm or less and particularly 2000 mm or less is believed to be readily utilized.

(Thickness and Width)

The thickness and width of the sheet constituting the coil stock of the present invention can be suitably selected in accordance with the size of a magnesium alloy structural member to be produced from the sheet. For example, when the coil stock is used as a raw material for housing of mobile electric and electronic devices, the sheet constituting the coil stock is believed to be readily utilized if it has a thickness of 0.02 mm or more and 3.0 mm or less and particularly 0.1 mm or more and 1 mm or less and a width of 50 mm or more and 2000 mm or less, particularly 100 mm or more, and furthermore 200 mm or more. When the thickness of the sheet is 0.3 to 2.0 mm and the width is 50 to 300 mm as described above, a coil stock having better flatness is easily produced.

(Warpage in Width Direction)

The coil stock of the present invention has a small amount of warpage in the width direction by being coiled at a certain temperature after warm working as described above. The amount of warpage is preferably smaller and more preferably 0.3% or less. The amount of warpage in the width direction is measured as follows. First, a coil stock will be described. As shown in FIG. 1(*a*), a coil stock 10 is obtained by coiling a long sheet 11. In the coil stock 10, the direction indicated by an arrow A in FIG. 1(*a*), that is, the direction in which the sheet 11 is coiled (coiling direction) or the direction in which the sheet 11 is uncoiled (uncoiling direction (feeding direction)) is a longitudinal direction of the sheet 11. The direction indicated by an arrow B in FIG. 1(*a*), that is, the direction perpendicular to the longitudinal direction is a width direction of the sheet 11.

The coil stock is uncoiled, and a test piece 1 for warpage amount obtained by cutting the outermost sheet in a length of 300 mm is prepared. The test piece 1 for warpage amount is placed on a horizontal table (flat surface plate) 100 as shown in FIG. 1(*b*). Regarding a gap 110 between the surface of the horizontal table 100 and the surface of the test piece 1 for warpage amount, the surface facing the horizontal table 100, the distance in the vertical direction is measured in the width direction of the test piece 1 for warpage amount with a measuring device such as a stainless scale or a clearance gage. The maximum distance h (mostly, the distance in the vertical direction at the center C of the test piece 1 for warpage amount in the width direction) is determined from the measured distances above, and the amount of warpage can be calculated from the above-described formula $(h/w)\times 100$ using the maximum distance h and the width w. In order to appropriately measure the warpage in the width direction, the length of the test piece used for the measurement of the amount of warpage in the width direction is set to be 300 mm because a sheet does not properly warp in the width direction if the sheet is excessively long, though this depends on the width. When the warpage in the width direction needs to be more appropriately measured, after the test piece for warpage amount is cut out, the test piece may be subjected to cold leveling with a roll leveler to remove the warpage in the longitudinal direction as much as possible.

(Flatness)

The sheet constituting the coil stock of the present invention has good flatness as described above. In the most preferred form of the sheet, substantially the entire surface of one side of the above-described test piece for flatness cut out in a length of 1000 mm is in contact with the horizontal table, that is, the above-described flatness is substantially 0 mm. As the flatness decreases, the sheet becomes flatter. Thus, the flatness is 5 mm or less, preferably 3 mm or less, more preferably 1 mm or less, and particularly preferably 0.5 mm or less. Flatness can be measured by various methods. In the present invention, the above-described method is employed because the effect caused by self-weight deformation is believed to be small.

Flatness is measured as follows. The coil stock 10 shown in FIG. 1(*a*) is uncoiled, and a test piece 2 for flatness (FIG.

Figure 2:
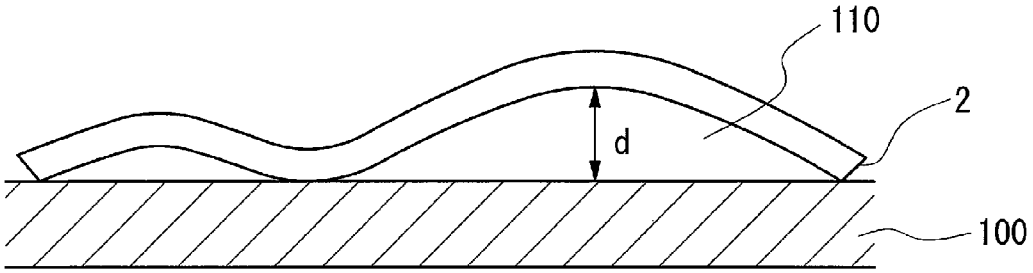
FIG. 2 is a schematic view for describing a method for measuring flatness.

2) obtained by cutting the innermost sheet in a length of 1000 mm is prepared. As shown in FIG. 2, the test piece 2 for flatness is placed on the horizontal table 100. Regarding a gap 110 between the surface of the horizontal table 100 and the surface of the test piece 2 for flatness, the surface facing the horizontal table 100, the distance in the vertical direction is measured with a measuring device such as a clearance gage as described above. The maximum value d of the measured values is defined as a flatness. FIGS. 1 and 2 show the state in which the test pieces 1 and 2 are placed so that the edges of the test pieces 1 and 2 come close to the horizontal table 100. However, the amount of warpage in the width direction and the flatness may be measured in a state in which, by turning the test pieces 1 and 2 shown in FIGS. 1 and 2 upside down, the test pieces 1 and 2 are placed so that the edges are away from the horizontal table 100. Note that, in FIGS. 1 and 2, the gap 110 is illustrated in an exaggerated manner for convenience of description.

The test piece 2 for flatness may be placed on the horizontal table 100 so that either of the outer peripheral surface in a coiled state or the inner peripheral surface in a coiled state serves as a surface that is in contact with the horizontal table 100. In the case where the outer peripheral surface serves as a surface that is in contact with the horizontal table 100, the warpage is convex toward the horizontal table 100 (convex downward). As a result, a gap is formed between the edge of the test piece 2 and the horizontal table 100, and the measurement is easily performed.

If a sheet located on the innermost peripheral side of the coil stock satisfies the flatness in the above-described specific range, a sheet located on the outer side of the sheet has a large bend radius and is subjected to gentle bending, and thus curling is not easily formed. The sheet located on the outer side satisfies the flatness in the above-described specific range. Therefore, in the present invention, a sheet located on the innermost peripheral side of the coil stock is employed as the test piece in the measurement of flatness.

(Mechanical Properties)

[Tensile Strength]

Since the sheet constituting the coil stock of the present invention is rolled, the sheet has higher strength than die cast materials and thixomolded materials if their compositions are the same, though this depends on the composition and the production conditions such as rolling performed. For example, the sheet can satisfy a tensile strength of 280 MPa or more. Depending on the composition and the production conditions, the sheet can satisfy a tensile strength of 300 MPa or more and furthermore 320 MPa or more. The tensile strength at room temperature (about 20° C.) is preferably 450 MPa or less because the sheet can have sufficient toughness such as elongation.

[0.2% Proof Stress]

The above-described high strength sheet also has good 0.2% proof stress. For example, the sheet can satisfy a 0.2% proof stress of 230 MPa or more as described above. Depending on the composition and the production conditions, the sheet can satisfy a 0.2% proof stress of 250 MPa or more. The 0.2% proof stress at room temperature (about 20° C.) is preferably 350 MPa or less because the sheet can have sufficient toughness such as elongation.

[Elongation]

The sheet constituting the coil stock of the present invention can have good elongation in spite of high strength as described above, though this depends on the composition and the production conditions. As elongation increases, cracking during coiling or warm leveling can be reduced and also cracking during plastic forming is not easily caused. For example, the elongation is 1% or more, preferably 4% or more, more preferably 5% or more, and particularly preferably 8% or more as described above. As tensile strength or 0.2% proof stress increases, elongation tends to decrease, and the upper limit of the elongation is believed to be about 15%. In the case where the coil stock of the present invention is composed of a worked sheet that has been subjected to leveling, the coil stock has good plastic formability even if the elongation is low because continuous recrystallization is easily caused during plastic forming.

[Vickers Hardness (Hv)]

The sheet constituting the coil stock of the present invention tends to have high hardness and, for example, satisfies a Vickers hardness (Hv) of 65 or more and furthermore 80 or more as described above. Since the sheet has high hardness, a magnesium alloy structural member produced from the coil stock of the present invention has high scratch resistance. Vickers hardness changes mainly because of residual stress described below. As residual stress increases, hardness tends to increase. In the range of compressive stress described below, the upper limit of the Vickers hardness (Hv) is believed to be 100.

[Residual Stress]

When the sheet has a compressive residual stress of more than 0 MPa and 100 MPa or less and particularly 5 MPa or more and 30 MPa or less, the elongation of the sheet is 100% or more in a temperature range in which plastic forming such as press forming is performed, for example, in a temperature range of 200 to 300° C. Therefore, the sheet can be subjected to sufficient plastic deformation into various shapes and thus has good plastic formability.

[Magnesium Alloy Structural Member]

A magnesium alloy structural member of the present invention is produced by a method for producing a magnesium alloy structural member of the present invention in which the coil stock of the present invention is uncoiled and the sheet constituting the coil stock is subjected to plastic forming. Examples of the plastic forming that can be employed include press forming, deep drawing, forging, and bending. Examples of the magnesium alloy structural member of the present invention that has been subjected to such plastic forming include magnesium alloy structural members in which the entire sheet is subjected to plastic forming, for example, three-dimensional structural members subjected to plastic forming such as a box; and magnesium alloy structural members in which only part of the sheet is subjected to plastic forming, that is, magnesium alloy structural members having a portion subjected to plastic forming. By performing plastic forming while the sheet is heated to 200 to 300° C., cracking or the like is not easily caused and a magnesium alloy structural member having good surface texture is obtained. Since the coil stock of the present invention having high strength and toughness is used as a raw material, the magnesium alloy structural member of the present invention also has high strength and toughness.

In addition, by uncoiling the coil stock of the present invention and suitably subjecting the sheet constituting the coil stock to various processings such as cutting and punching that change a shape, a sheet-shaped magnesium alloy structural member can be obtained.

By subjecting the obtained magnesium alloy structural member to an anti-corrosion treatment such as a chemical conversion treatment or an anodic oxidation treatment and a surface treatment such as coating, polishing, or diamond cutting, the corrosion resistance can be further improved, the mechanical protection can be achieved, and the ornamentation, design, and metallic texture can be improved to increase the commercial value.

[Production Method]

Each of steps in the production method of the present invention will now be described in detail.

{Preparation Step}

Examples of a raw material sheet prepared in a preparation step include a cast material and a rolled sheet obtained by rolling the cast material. When the cast material is used, rolling is employed as warm working as described above. When the rolled sheet is used, leveling is employed as warm working as described above. In any case, a method for producing the coil stock of the present invention typically includes a casting step and a rolling step.

(Casting)

For example, an ingot cast material can be used as a starting material of the coil stock of the present invention. However, when the sheet constituting the coil stock of the present invention is required to be a long sheet, the cast material serving as a starting material is preferably a long sheet. A continuous casting process is preferably employed as a casting process for obtaining a long sheet because of the reason below. Since a continuous casting process allows rapid solidification, internal defects caused by segregation, oxides, or the like can be reduced even if the content of additive elements is high, and a cast material having good plastic formability such as rolling property is obtained. That is, in the continuous cast material, cracking generated from the internal defects during plastic forming such as rolling is not easily caused. In particular, in AZ91 alloy and an alloy containing Al in substantially the same amount as that of AZ91 alloy, generation of impurities in crystal and precipitated impurities and segregation are easily caused during casting. Such impurities in crystal and precipitated impurities and segregates readily remain even if plastic forming such as rolling is performed after the casting. However, by employing the continuous cast material, the generation of impurities in crystal and precipitated impurities and segregation can be easily reduced even if alloys containing additive elements such as Al in a large amount are used. Examples of the continuous casting process include a twin-roll process, a twin-belt process, and a belt-and-wheel process. For the production of a sheet-shaped cast material, a twin-roll process and a twin-belt process are suitable, and a twin-roll process is particularly suitable. In particular, a cast material produced by a casting process disclosed in WO/2006/003899 is preferably used. The thickness, width, and length of the cast material can be suitably selected so that a desired sheet such as a rolled sheet is obtained. The thickness of the cast material is preferably 10 mm or less and particularly preferably 5 mm or less because segregation is easily caused in an excessively thick cast material. The width of the cast material can be set to be a width that allows the cast material to be produced in production equipment. If the obtained continuous cast material is coiled in a cylindrical shape, the continuous cast material is easily transferred to the next step. When the temperature during coiling, in particular, the temperature of a start-of-coiling portion of the cast material is about 100 to 200° C., even alloys such as AZ91 alloy in which cracking is easily caused are easily bent and coiled.

(Solution Treatment)

By performing a solution treatment before the cast material is rolled, the composition of the cast material can be homogenized and a precipitate containing elements such as Al can be dissolved again to improve the toughness. The solution treatment is performed at a heating temperature of 350° C. or more and particularly 380° C. or more and 420° C. or less for a holding time of 0.5 hours or more and particularly 1 hour or more and 40 hours or less. In the case of Mg—Al series alloys, the holding time is preferably increased as the content of Al increases. In a cooling step after the holding time, the precipitation of a coarse precipitate can be suppressed by increasing the cooling rate (preferably 50° C./min or more) using accelerated cooling such as water cooling or air blast cooling. In the case where a cast coil stock is used, the solution treatment may be performed in a coiled state (batch treatment) or may be performed by uncoiling the cast coil stock and continuously inserting a cast material into a heating furnace (continuous treatment).

(Rolling)

The rolling performed on the cast material and the material subjected to a solution treatment preferably includes a hot rolling step or a warm rolling step which is performed while a raw material (to be subjected to rolling) containing the cast material is heated to more than 100° C. and particularly 150° C. or more and 400° C. or less. Rolling is preferably performed while the raw material is heated to the temperature above because cracking or the like is not easily caused during the rolling even if the reduction ratio per pass is increased. When the temperature is set to be 150° C. or more, less cracks or the like are formed during the rolling. Less cracks are formed as the heating temperature is increased. However, at more than 400° C., the mechanical properties of a rolled sheet to be obtained may degrade due to the thermal degradation of a reduction roll, the degradation caused by seizing of a surface of the rolled sheet, or the increase in the size of crystal grains constituting the rolled sheet. Therefore, the temperature of the raw material during rolling is preferably 350° C. or less, more preferably 300° C. or less, and further preferably 280° C. or less. In particular, at 150° C. or more and 250° C. or less, the thermal degradation and the increase in the size of crystal grains are easily suppressed. At 200 to 350° C., particularly 250° C. or more and furthermore 270° C. or more and 330° C. or less, good rolling property is provided. To increase the temperature of the raw material to the above-described temperature, for example, the raw material is heated. The raw material is heated using, for example, an atmosphere furnace (heat box). The reduction roll may be heated. The heating temperature of the reduction roll is, for example, 100 to 250° C. Both the raw material and reduction roll may be heated. The reduction ratio is a value represented by $\{(t_0-t_1)/t_0\}\times100$, wherein $t_0$ represents the thickness of a raw material before rolling and $t_1$ represents the thickness of a rolled sheet after rolling.

The rolling may be performed with one pass or multiple passes, but at least one pass is preferably performed by the above-described warm rolling. In the case where rolling is performed with multiple passes, conditions such as the heating temperature of a raw material (to be subjected to rolling), the temperature of a reduction roll, the reduction ratio, and the line speed may be changed for each of the passes. By performing rolling with multiple passes, a thin sheet is obtained, the average grain size of the sheet is decreased (e.g., 10 μm or less and preferably 5 μm or less), and the plastic formability such as press formability is improved. The number of passes, the reduction ratio of each pass, and the total reduction ratio may be suitably selected to obtain a sheet having a desired thickness and width. For example, the reduction ratio per pass is 5% or more and 40% or less and the total reduction ratio is 75% or more and 85% or less. In the case where rolling is performed with multiple passes, an intermediate heat treatment (heating temperature:

150 to 350° C. (preferably 300° C. or less), holding time: 0.5 to 3 hours) may be performed between the passes. The rolling is easily performed by using a lubricant because the frictional resistance during rolling can be reduced and the seizing of the rolled sheet can be prevented.

When the coil stock of the present invention is composed of a rolled sheet, the rolled sheet is coiled after the temperature of the rolled sheet just before coiling is decreased to a low temperature of 100° C. or less. If the rolled sheet has a high temperature of more than 100° C., the rolled sheet is easily bent due to its high plastic formability. In addition, although the rolled sheet is easily coiled even with a small coiling diameter of 1000 mm or less, the warpage in the width direction and curling are formed on the coiled rolled sheet, resulting in poor flatness of the rolled sheet. On the other hand, a rolled sheet obtained by performing the warm rolling described above has good plastic formability and can be sufficiently bent even at 100° C. or less. Therefore, in one embodiment of the production method of the present invention, the rolled sheet is coiled at 100° C. or less as described above. By coiling the rolled sheet at a relatively low temperature in such a manner, the warpage in the width direction and curling are not easily formed and the coil stock of the present invention having good flatness can be produced. In the production method of the present invention, a final heat treatment (annealing) is not performed after rolling and the rolled sheet is coiled at 100° C. or less after rolling. Thus, strain (shear zone) introduced by the rolling can be left in the rolled sheet to some extent. The temperature of the rolled sheet just before coiling is preferably 75° C. or less and more preferably 50° C. or less. When the lower limit of the temperature is set to be about room temperature, cracking is not easily caused during coiling and the energy used for cooling can be prevented from excessively increasing. When the coil stock in which the strain is left is used as a raw material for plastic forming such as press forming, dynamic recrystallization can be caused during plastic forming and thus the raw material has good plastic formability.

A decrease in the temperature of the rolled sheet just before coiling to 100° C. or less can be achieved by natural cooling realized by increasing the distance of the rolled sheet traveling until coiling or accelerated cooling using accelerated cooling means such as air blast cooling (air cooling) realized by sending low-temperature air, water cooling realized by spraying low-temperature water, or use of a water-cooling roll. In the case of natural cooling, additional cooling means is not required. In the case of accelerated cooling, accelerated cooling means may be disposed at any position between the position after rolling and the position just before coiling, that is, at any position between the downstream side of a reduction roll in a direction in which the rolled sheet travels (the outlet side of the reduction roll) and a coiling reel so that the sheet just before coiling has a desired temperature. For example, accelerated cooling means may be disposed near the inlet of the coiling reel. In the case of accelerated cooling, the cooling rate can be easily controlled, and the traveling distance of the rolled sheet is decreased and thus the size of equipment can be reduced.

In the case where rolling is performed with multiple passes, the feeding and coiling of the raw material (rolled sheet being subjected to rolling) are repeatedly performed multiple times. In this case, the coiling at 100° C. or less may be performed once or multiple times. For example, the rolled sheet may be coiled at 100° C. or less for each pass. Even when the coiling at 100° C. or less is performed only after the rolling of a final pass, warpage and deformation can be sufficiently reduced. In this case, the heating efficiency is high and the productivity of the coil stock is high.

Through the rolling step, a coil stock having a small amount of warpage and deformation and good flatness can be obtained as described above. However, a magnesium alloy sheet having better flatness and having a smaller amount of warpage and deformation (in particular, warpage in the longitudinal direction) or substantially no warpage or deformation can be produced by uncoiling the coil stock and further performing leveling described below. Since the rolled sheet constituting a rolled coil stock obtained by coiling the rolled sheet under the specific conditions above has good flatness, the rolled sheet is easily supplied to a leveling machine, which results in high productivity of the coil stock.

(Pretreatment)

In the case where the coil stock of the present invention is composed of a worked sheet that has been subjected to leveling, the leveling may be directly performed on the rolled coil stock after rolling. However, scratches present on the surface of the rolled sheet, working fluid (e.g., lubricant) attached to the surface, and an oxide layer formed on the surface can be removed by performing a grinding treatment before the leveling to make the surface clean and smooth. Such a sheet having good surface texture is easily subjected to uniform leveling. As described below, for example, even when a small pressing amount is provided by relatively increasing the gap between a pair of leveling rolls used for leveling, a coil stock having good flatness is easily obtained by subjecting the sheet having good surface texture to leveling. The grinding treatment may be performed by, for example, a wet treatment that uses a grinding belt.

(Leveling)

In the case where the coil stock of the present invention is composed of a worked sheet that has been subjected to leveling, a rolled coil stock is used as a raw material, warm leveling is performed at more than 100° C. and 350° C. or less as described above, and the worked sheet is coiled after the temperature of the worked sheet just before coiling is decreased to a low temperature of 100° C. or less.

The leveling is performed in order to improve flatness and maintain good plastic formability realized by keeping a shear zone. Such purposes are achieved by correcting or removing the curling and the warpage in the width direction formed on a rolled sheet when the rolled sheet is coiled after rolling and by adjusting the amount of strain (residual strain) introduced during rolling. When the temperature of the raw material (rolled sheet) during the leveling is more than 100° C., the raw material has good plastic formability. As a result, the warpage in the width direction and curling can be sufficiently leveled to achieve good flatness. As the temperature increases, the plastic formability increases. However, if the temperature is more than 350° C., the strain introduced by rolling is released due to the heat and thus a shear zone is not sufficiently present in the raw material. Consequently, continuous recrystallization is not easily caused during plastic forming such as press forming. The temperature is preferably 150° C. or more and 300° C. or less. In particular, since a magnesium alloy has high elongation in a temperature range of 200° C. or more and 300° C. or less, the temperature is more preferably 200 to 300° C. The temperature of the raw material may be increased to above-described temperature by, for example, heating the raw material. The heating of the raw material during leveling is performed with, for example, heating means such as a heating furnace filled with hot air or an electric heating apparatus. The raw material heated with the heating means may be transferred to leveling means and then leveling may be performed. However, the heating means and leveling means are preferably disposed in a continuous manner because a decrease in the temperature of the raw material can be suppressed. Alternatively, a plurality of rolls for leveling may be installed in the heating furnace. In this case, after the raw material is introduced into the heating furnace to perform heating, the raw material is introduced to the rolls.

The leveling may be performed by passing a raw material through one or more pairs of leveling rolls disposed so as to sandwich the raw material, the pairs of leveling rolls being adjacent to each other, to provide bending. For example, strain-imparting means disclosed in Patent Literature 1 can be used. The flatness of a worked sheet obtained after the leveling and the amount of shear zone present in the worked sheet may be controlled by adjusting, for example, the diameter of the leveling rolls, the number of pairs of leveling rolls through which the raw material is caused to pass, the gap between the pair of leveling rolls (the pressing amount of the pair of leveling rolls), the distance between the leveling rolls which are adjacent to each other in the direction in which the raw material travels, and the traveling speed of the raw material. For example, the diameter of the leveling rolls is about ϕ10 to 50 mm, the total number of the leveling rolls is about 10 to 40, and the pressing amount is about −4.0 to 0 mm.

Furthermore, by performing the leveling while applying a certain tension to the raw material, a magnesium alloy coil stock having a better flatness of 0.5 mm or less is obtained. Herein, when the leveling is continuously performed on a long raw material such as a rolled coil stock, the raw material is set in a feeding reel and uncoiled with the feeding reel and then coiled with a coiling reel. Thus, the raw material can be leveled through the travel between the feeding reel and the coiling reel. In the travel, the tension applied to the raw material is substantially zero (about 3 MPa or less), which means that substantially no tension is applied to the raw material. When a tension of 30 MPa or more is applied to the raw material, the flatness can be further improved. As the tension increases, the flatness tends to be improved. When the tension is 150 MPa or less, the flatness can be improved without breaking the raw material. The tension is preferably 40 MPa or more and 120 MPa or less. The tension can be adjusted by controlling the rotation speed of the feeding reel and coiling reel or by using a tension-regulating device equipped with a dancer roll.

The worked sheet is then coiled after the temperature of the worked sheet after the leveling and just before coiling is decreased to a low temperature of 100° C. or less, preferably 75° C. or less, and more preferably 50° C. or less using natural cooling or accelerated cooling means as described above. This provides a coil stock composed of a sheet having a small amount of warpage and deformation. Also in this form, the coil stock obtained by performing leveling without performing a final heat treatment (annealing) after rolling is in a state in which strain (shear zone) introduced by rolling is left to some extent as described above. Therefore, when the coil stock is used as a raw material of a member subjected to plastic forming, dynamic recrystallization can be caused during plastic forming as described above.

Between the solution treatment after casting and the step of obtaining an end product (magnesium alloy structural member), the total time for which a raw material composed of a magnesium alloy is held at 150 to 300° C. is set to be 0.5 to 12 hours and the raw material is heated so that the temperature does not exceed 300° C. This can provide a microstructure (e.g., the total area percentage of an intermetallic compound is 11% or less) including a fine intermetallic compound (e.g., average grain size: 0.5 μm or less) homogeneously dispersed therein. A magnesium alloy structural member having such a microstructure has high corrosion resistance and impact resistance.

(Other Treatments)

The obtained coil stock having good flatness can be directly used as a raw material of a member subjected to plastic forming such as press forming. Before the coil stock is subjected to various processings, e.g., cutting and plastic forming such as press forming, the surface texture of the coil stock may be improved by performing the above-described grinding treatment such as a wet belt polishing. The grinding treatment removes the scratches, working fluid, and an oxide layer on the surface of the raw material as described above, and thus a coil stock having a clean and smooth surface can be obtained. Before or after the various processings such as cutting and plastic forming, an anti-corrosion treatment such as a chemical conversion treatment or an anodic oxidation treatment can be performed. In addition, cold leveling may be performed after the warm leveling. Better flatness can be achieved by performing the cold leveling. In the cold leveling, a commercially available roll leveler for cold leveling can be used.

Embodiments of the present invention will now be more specifically described based on Test Examples.

Test Example 1

Sheets composed of a magnesium alloy were produced under various conditions. The flatness and mechanical properties of the sheets were examined.

In this test, coil stocks and a sheet member each having a composition equivalent to that of AZ91 alloy serving as a magnesium alloy were produced. For comparison, a commercially available die cast sheet (thickness: 0.6 mm, Sample No. 200) composed of AZ91 alloy and a commercially available AZ31 alloy sheet (thickness: 0.6 mm, Sample No. 300, obtained by cutting a coil stock) were prepared.

[Coil Stock: Sample Nos. 1 and 2]

Each of the coil stocks was produced as follows. An ingot (commercially available product) having a composition equivalent to that of AZ91 alloy was heated to 650 to 700° C. in an inert atmosphere to prepare molten metal. A long cast sheet (thickness: 4 mm) was produced from the molten metal by a twin-roll continuous casting process in an inert atmosphere and then coiled. The cast coil stock was subjected to a solution treatment at 400° C. for 24 hours.

The coil stock subjected to a solution treatment was used as a raw material, and rolling was performed with multiple passes by repeatedly coiling and uncoiling the raw material. In the rolling, the reduction ratio per pass was 5 to 40%, the heating temperature of the raw material was 150 to 250° C., and the roll temperature was 100 to 250° C. In the steps after the solution treatment, the total time for which the raw material was held in a temperature range of 150 to 300° C. was set to be 0.5 to 12 hours. The obtained rolled sheet (thickness: 0.6 mm, width: 210 mm) was coiled with a coiling diameter (internal diameter) of 500 mm 1000 mm). By suitably cutting both edges of the raw material at a proper timing before or during rolling, edge cracking caused by rolling can be prevented from proceeding even if edge cracking has been generated. Consequently, the yield can be increased.

Figure 3:
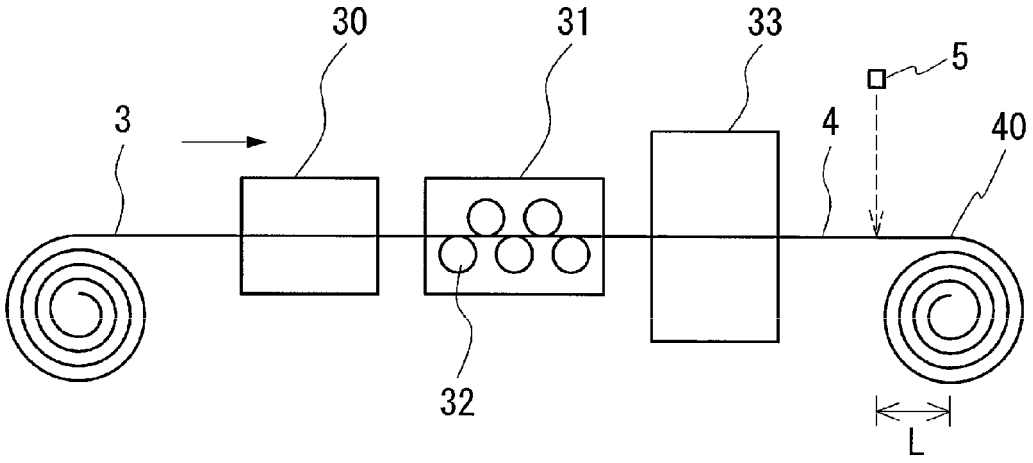
FIG. 3 is a diagram schematically showing processes of performing leveling on a raw material and coiling the raw material.

The obtained rolled sheet was set in a feeding reel and uncoiled, and furthermore was subjected to leveling. The obtained worked sheet was coiled using a coiling reel to produce a coil stock composed of the worked sheet. The coil stock was referred to as sample Nos. 1 and 2. As shown in FIG. 3, the leveling was performed by uncoiling the rolled coil stock and using a heating furnace 30 that can heat a rolled sheet 3 serving as a raw material and a roll leveler 31 equipped with a roll unit including at least one leveling roll 32 that continuously imparts bending to the heated raw material. The roll unit includes a plurality of leveling rolls 32 disposed in a staggered manner so as to face each other in the vertical direction. In the sample No. 1, the pressing amount (the difference between the diameter of the rolls and the distance x between the centers of the pair of rolls) of a pair of rolls disposed so as to sandwich the raw material was set to be 3 mm. In the sample No. 2, the pressing amount was set to be 2 mm.

The raw material (rolled sheet 3) is transferred in a direction indicated by an arrow in FIG. 3. The raw material is heated in the heating furnace 30 in advance and transferred to the roll leveler 31. In the roll leveler 31, when the raw material passes between the leveling rolls 32 disposed in the vertical direction in the roll unit, bending is imparted to the raw material by the rolls 32. In this test, the bending was repeatedly imparted while the rolled sheet was heated to 200° C. in the heating furnace. In the sample No. 1, the raw material was passed through the roll unit while substantially no tension was applied to the raw material (while there was only a tension that allows the raw material to move between the feeding reel and the coiling reel). In the sample No. 2, the raw material was passed through the roll unit while a tension of 50 MPa was applied. A worked sheet 4 ejected from the roll leveler 31 was cooled using a cooling system 33 (herein, air blast cooling means) disposed on the downstream side of the roll leveler 31 and before the coiling reel (not shown). The worked sheet 4 was then coiled with the coiling reel. In this test, a temperature sensor 5 was disposed at a position 1000 mm (distance L) away from the position at which the worked sheet 4 that had passed through the cooling system 33 was in contact with the coiling reel or the position 40 at which the worked sheet 4 was in contact with a start-of-coiling portion toward the cooling system 33 side (upstream side). The temperature of the worked sheet just before the worked sheet was coiled with the coiling reel was measured with the temperature sensor 5. The volume of air was adjusted in accordance with the traveling speed of the worked sheet so that the temperature was decreased to 100° C. or less (herein, room temperature (about 20° C.) to 50° C.). In each of the sample Nos. 1 and 2, a plurality of such coil stocks were produced.

The temperature of the worked sheet just before the worked sheet was coiled with the coiling reel can be easily measured by, for example, disposing a noncontact temperature sensor near the coiling reel. Herein, a plurality of temperature sensors 5 were disposed in the width direction of the worked sheet, and the average temperature in the width direction of the worked sheet was defined as the temperature just before coiling. By suitably cutting both edges of the raw material before leveling, edge cracking caused by leveling can be prevented from proceeding even if edge cracking has been generated by rolling or the like. Consequently, the yield can be increased.

[Sheet Member: Sample No. 100]

A sheet member was produced as follows. An ingot (commercially available product) having a composition equivalent to that of AZ91 alloy was heated to 650 to 700° C. in an inert atmosphere to prepare molten metal. A cast sheet was produced from the molten metal by a twin-roll continuous casting process in an inert atmosphere. The cast sheet was cut into a predetermined length to prepare a plurality of cast sheets having a thickness of 4 mm. Each of the cast sheets was subjected to a solution treatment at 400° C. for 24 hours. Rolling was then performed with multiple passes to produce a rolled sheet having a thickness of 0.6 mm. The rolling conditions were the same as those of the coil stock in the sample Nos. 1 and 2. Each of the obtained rolled sheets was subjected to warm leveling using the above-described roll leveler under the same conditions as those of the sample No. 1 (pressing amount: 3 mm). The obtained worked sheet (width: 210 mm, length: 1000 mm) was referred to as sample No. 100.

<<Flatness>>

The flatness of the coil stocks of the sample Nos. 1 and 2 and the sheet member of the sample No. 100 was measured. Each of the coil stocks was uncoiled, and a sheet located on the innermost peripheral side of the coil stock was cut into a length of 1000 mm to prepare a test piece. The test piece was placed on a horizontal table so that the outer peripheral surface in a coiled state faces the horizontal table. The maximum distance in the vertical direction between the surface of the horizontal table and a portion of the surface of the test piece, the portion being not in contact with the horizontal table, was measured and defined as the flatness of the test piece. Table shows the average values when n=3. The sheet member was also placed on the horizontal table in the same manner and the flatness was measured as described above. Table shows the average values when n=3.

<<Mechanical Properties>>

The prepared sample Nos. 1, 2, 100, 200, and 300 were subjected to a tensile test (gage length GL: 50 mm, cross head speed: 5 mm/min) at room temperature (about 20° C.) to measure tensile strength (MPa), 0.2% proof stress (MPa), and elongation (%) (the number of evaluations: n=3 for each sample). In this test, JIS 13B sheet-shaped specimens (JIS Z 2201 (1998)) were prepared from each of the samples (thickness: 0.6 mm) and the tensile test was performed on the basis of a method of tensile test for metallic materials in JIS Z 2241 (1998). Regarding the coil stocks of the sample Nos. 1 and 2 and the AZ31 alloy sheet of the sample No. 300, a specimen (RD) was made in such a manner that the longitudinal direction (herein, rolling direction) of an uncoiled coil stock corresponded to the longitudinal direction of the specimen and a specimen (TD) was made in such a manner that the width direction (direction perpendicular to the rolling direction) corresponded to the longitudinal direction of the specimen. Regarding the sheet member of the sample No. 100, a specimen (RD) was made in such a manner that the rolling direction of the sheet member corresponded to the longitudinal direction of the specimen and a specimen (TD) was made in such a manner that the width direction (direction perpendicular to the rolling direction) corresponded to the longitudinal direction of the specimen. Regarding the cast sheet of the sample No. 200, a specimen whose longitudinal direction was freely selected was prepared. Table shows the average values when n=3.

The Vickers hardness (Hv) of the coil stocks of the sample Nos. 1 and 2 and the sheet member of the sample No. 100 was measured. In this test, Vickers hardness was measured at multiple points (herein, five points for each section, meaning ten points in total) in the central portions of a longitudinal section obtained by cutting the sample in the longitudinal direction (rolling direction) and a transverse section obtained by cutting the sample in the width direction (direction perpendicular to the rolling direction), except for an outer layer portion from the surface to a depth of 0.05 mm in the sheet thickness direction. Table shows the average values.

The residual stress of the coil stocks of the sample Nos. 1 and 2, the sheet member of the sample No. 100, and the AZ31 alloy sheet of the sample No. 300 was measured. The residual stress was measured by a $\sin^2 \psi$ method using a (1004) face as a measurement surface with the following micro-part X-ray stress measuring equipment. The measurement was performed in the rolling direction of each of the specimens. Table shows the measurement results. In Table, the minus (−) numbers indicate compressive residual stress. The measurement conditions are shown below.

Equipment used: Micro-part X-ray stress measuring equipment (MSF-SYSTEM manufactured by Rigaku Corporation)

X-ray used: Cr-Kα (V filter)

Excitation condition: 30 kV, 20 mA

Measurement region: ϕ2 mm (collimator diameter used)

Measurement method: $\sin^2 \psi$ method (iso-inclination method with fluctuation) ψ=0°, 10°, 15°, 20°, 25°, 30°, 35°, 40°, and 45°

Measurement surface: Mg (1004) face

Constant used: Young's modulus=45,000 MPa and Poisson's ratio=0.306

Measurement point: central portion of sample

Measurement direction: rolling direction

It is clear that the coil stocks of the sample Nos. 1 and 2 have high values of tensile strength, 0.2% proof stress, and elongation both in the longitudinal direction (rolling direction) and the width direction, and the difference in such values between the longitudinal direction and the width direction is small. It is also clear that the obtained coil stocks have high tensile strength and also high elongation, which means such coil stocks have a good balance between high strength and high toughness. In addition, it is clear that the obtained coil stocks also have compressive residual stress.

It is clear that, by performing leveling while applying a certain tension, a coil stock having a better flatness of 0.5 mm or less is obtained. It is also clear that, by performing leveling while applying a certain tension, a coil stock having high compressive residual stress, that is, a coil stock including many shear zones is obtained.

The obtained coil stock was subjected to press forming and punching to produce a magnesium alloy structural member. The magnesium alloy structural member has high tensile strength and also high elongation, which means that such a magnesium alloy structural member has a good balance between high strength and high toughness. In particular, when the coil stock of the sample No. 2 subjected to leveling while applying a certain tension was used, the obtained magnesium alloy structural member had better plastic formability.

TABLE

| | | Sample No. | | | | |
|---|---|---|---|---|---|---|
| | | 1 | 2 | 100 | 200 | 300 |
| Composition | | AZ91 | AZ91 | AZ91 | AZ91 | AZ31 |
| Form | | Coil stock | Coil stock | Sheet member | Die cast material | Wrought material |
| Tension during leveling | | No | 50 MPa | — | — | No |
| Flatness (mm) | | 1.5 | 0.5≤ | 1.5 | — | — |
| Tensile strength (RD) | MPa | 329 | 344 | 398 | 203 | 310 |
| Tensile strength (TD) | MPa | 317 | 336 | 398 | — | 325 |
| 0.2% proof stress (RD) | MPa | 266 | 283 | 326 | 192 | 230 |
| 0.2% proof stress (TD) | MPa | 244 | 264 | 332 | — | 291 |
| Elongation (RD) | % | 7.0 | 5.7 | 2.6 | 0 | 12.0 |
| Elongation (TD) | % | 4.3 | 4.0 | 2.4 | — | 15.8 |
| Vickers hardness (Hv) | — | 80 | 84 | 90 | — | — |
| Residual stress | MPa | 0~−5 | −5~−15 | −50~−58 | — | −1~−2 |

As is clear from Table, the coil stocks of the sample Nos. 1 and 2 coiled after cooled to 100° C. or less just before coiling have a small value of flatness after uncoiling, which means that such coil stocks have good flatness. In particular, it is found that the coil stocks of the sample Nos. 1 and 2 have flatness equal to or smaller than the flatness of the sheet member of the sample No. 100 which is not coiled. Furthermore, the coil stocks of the sample Nos. 1 and 2 were uncoiled and a sheet located on the outermost periphery was cut into a length of 300 mm to measure the amount of warpage in the width direction ((maximum distance h/width: 210 mm)×100(%)). The amount of warpage was 0.5% or less for each of the coil stocks. As described above, by performing warm working and then performing coiling after the temperature is decreased to a certain temperature just before coiling, even when the coiling diameter is as small as 1000 mm or less, there is obtained a coil stock with good flatness in which curling is not easily formed and warpage in the width direction is not easily formed even if the number of turns is increased. As a result of visual inspection, the coil stocks of the sample Nos. 1 and 2 had no cracks and good surface texture.

Test Example 2

A coil stock having a composition equivalent to that of AZ91 alloy was produced under the conditions below. In this test, as in Test Example 1, a cast coil stock (thickness: 5 mm) was produced by a twin-roll continuous casting process, and the produced coil stock was subjected to a solution treatment at 400° C. for 24 hours. The coil stock after the solution treatment was used as a raw material. Rolling was continuously performed on a raw material sheet having a temperature of 250° C. with multiple passes until the thickness of the sheet was reduced to 0.6 mm to produce a long rolled sheet. The long rolled sheet was coiled (width: 210 mm). In this test, in the coiling of a final pass, cold air having a temperature of 20° C. was caused to blow upon the rolled sheet to forcibly decrease the temperature to 100° C. or less. The coiled rolled coil stock was preheated to 200° C. and the rolled coil stock heated to 200° C. was uncoiled. The rolled sheet was subjected to leveling under the same conditions as those of the sample No. 1 in Test Example 1. Cold air having a temperature of 20° C. was caused to blow upon the worked sheet subjected to leveling to forcibly decrease the temperature to 100° C. or less, and then the worked sheet was coiled. As in Test Example 1, a test piece for flatness (length: 1000 mm, width: 210 mm) and a test piece for warpage amount (length: 300 mm, width: 210 mm) were prepared from the obtained coil stock. As a result of the measurement of flatness and the amount of warpage in the width direction, the flatness was 1.0 mm or less and the amount of warpage was 0.5% or less. Furthermore, the test piece for warpage amount was subjected to cold leveling with a roll leveler to allow warpage in the width direction to be appropriately measured. As a result of the measurement of the amount of warpage in the width direction, the amount of warpage was 0.5% or less.

The above-described embodiment can be suitably modified without departing from the scope of the present invention and is not limited to the above-described configuration. For example, the composition of a magnesium alloy (type and content of additive element), the internal diameter of a coil stock, and the thickness and width of a sheet can be suitably changed. In addition, there can be employed a production method including a step of coiling a rolled sheet while the temperature of the rolled sheet just before coiling is set to be a certain temperature, instead of the above-described leveling.

INDUSTRIAL APPLICABILITY

The magnesium alloy structural member of the present invention can be suitably used for various constitutional members of electric and electronic devices, in particular, housings of mobile or small electric and electronic devices and members in various fields that need to have high strength, such as constitutional members of transport machines, e.g., automobiles and airplanes. The magnesium alloy coil stock of the present invention can be suitably used as a raw material of the above-described magnesium alloy structural member of the present invention. The method for producing a magnesium alloy structural member of the present invention and the method for producing a magnesium alloy coil stock of the present invention can be suitably used for the production of the above-described magnesium alloy structural member of the present invention and the production of the above-described magnesium alloy coil stock of the present invention, respectively.

REFERENCE SIGNS LIST

1 test piece for warpage amount
2 test piece for flatness
10 coil stock
11 sheet
3 rolled sheet
30 heating furnace
31 roll leveler
32 leveling roll
33 cooling system
4 worked sheet
40 position at which worked sheet is in contact with coiling reel or start-of-coiling portion
5 temperature sensor
100 horizontal table
110 gap

The invention claimed is:

1. A magnesium alloy coil stock produced by coiling a sheet composed of a magnesium alloy in a cylindrical shape,
wherein an internal diameter of the coil stock is 400 mm or more and 1000 mm or less, and
the coil stock satisfies an amount of warpage in a width direction below:
the amount of warpage in a width direction when the amount of warpage in a width direction % is defined by:
maximum distance h in vertical direction/width w of test piece for warpage amount×100%,
the amount of warpage in a width direction is 0.5% or less, wherein, when a sheet located on an outermost peripheral side of the sheet constituting the coil stock is cut into a length of 300 mm to obtain a test piece for warpage amount and the test piece for warpage amount is placed on a horizontal table, the maximum distance in a vertical direction between a surface of the horizontal table and a portion of one surface of the test piece for warpage amount, the portion being not in contact with the horizontal table, in a width direction of the test piece for warpage amount is referred to as h and the width of the test piece for warpage amount is referred to as w,
wherein the magnesium alloy contains Al as an additive element in an amount of 8.3% or more by mass and 9.5% or less by mass, and
wherein the coil stock satisfies a flatness below:
flatness
when a sheet located on an innermost peripheral side of the sheet constituting the coil stock is cut into a length of 1000 mm to obtain a test piece for flatness and the test piece for flatness is placed on a horizontal table, the maximum distance in a vertical direction between a surface of the horizontal table and a portion of one surface of the test piece for flatness, the portion being not in contact with the horizontal table, is defined as a flatness, the flatness being 5 mm or less.

2. The magnesium alloy coil stock according to claim 1, wherein the flatness is 0.5 mm or less.

3. The magnesium alloy coil stock according to claim 1, wherein the thickness of the sheet constituting the coil stock is 0.02 mm or more and 3.0 mm or less, and
the width of the sheet constituting the coil stock is 50 mm or more and 2000 mm or less.

4. The magnesium alloy coil stock according to claim 1, wherein the thickness of the sheet constituting the coil stock is 0.3 mm or more and 2.0 mm or less, and
the width of the sheet constituting the coil stock is 50 mm or more and 300 mm or less.

5. The magnesium alloy coil stock according to claim 1, wherein the tensile strength of the sheet constituting the coil stock is 280 MPa or more and 450 MPa or less.

6. The magnesium alloy coil stock according to claim 1, wherein the 0.2% proof stress of the sheet constituting the coil stock is 230 MPa or more and 350 MPa or less.

7. The magnesium alloy coil stock according to claim 1, wherein the elongation of the sheet constituting the coil stock is 1% or more and 15% or less.

8. The magnesium alloy coil stock according to claim 1, wherein the Vickers hardness (Hv) of the sheet constituting the coil stock is 65 or more and 100 or less.

9. The magnesium alloy coil stock according to claim 1, wherein the residual stress of the sheet constituting the coil stock is more than 0 MPa and 100 MPa or less.

* * * * *